US010597824B2

(12) United States Patent
Coutinho et al.

(10) Patent No.: US 10,597,824 B2
(45) Date of Patent: Mar. 24, 2020

(54) COMPOSITIONS AND METHODS FOR IMPROVING PROPERTIES OF LIGNOCELLULOSIC MATERIALS

(71) Applicant: SOLENIS TECHNOLOGIES, L.P., Wilmington, DE (US)

(72) Inventors: Cecil Coutinho, Wilmington, DE (US); Susan M. Ehrhardt, Wilmington, DE (US)

(73) Assignee: SOLENIS TECHNOLOGIES, L.P., Wilmington, DE (US)

( * ) Notice: Subject to any disclaimer, the term of this patent is extended or adjusted under 35 U.S.C. 154(b) by 0 days.

(21) Appl. No.: 16/018,936

(22) Filed: Jun. 26, 2018

(65) Prior Publication Data

US 2019/0390409 A1 Dec. 26, 2019

(51) Int. Cl.
*D21H 21/00* (2006.01)
*D21H 21/16* (2006.01)
(Continued)

(52) U.S. Cl.
CPC ..... *D21H 21/16* (2013.01); *D21H 17/28* (2013.01); *D21H 17/42* (2013.01); *D21H 17/66* (2013.01);
(Continued)

(58) Field of Classification Search
CPC ..... D21H 21/16; D21H 17/28; D21H 17/66; D21H 19/54; D21H 21/28; D21H 19/34;
(Continued)

(56) References Cited

U.S. PATENT DOCUMENTS 5,221,435 A 6/1993 Smith, Jr.
5,685,815 A * 11/1997 Bottorff ..... D21H 17/14 493/186
(Continued)

FOREIGN PATENT DOCUMENTS

JP 200288683 A 3/2002
WO 2011133996 A 11/2011

OTHER PUBLICATIONS

Xinlei Wu, et al., "Synthesis of cationic styrene-acrylic acid ester copolymer emulsion for paper sizing", Journal of Bioresources and Bioproducts, 2016, 1(1): 36-41.
(Continued)

*Primary Examiner* — Eisa B Elhilo
(74) *Attorney, Agent, or Firm* — Lorenz & Kopf, LLP

(57) ABSTRACT

A size press composition for improving properties of lignocellulosic material is provided herein. The size press composition includes an aluminum salt and an anionic styrene acrylate emulsion sizing agent. The aluminum salt and the anionic styrene acrylate emulsion sizing agent are substantially homogeneously dispersed within the size press composition based on visual observation utilizing a microscope at 10× magnification. A size press composition formed by a process is also provided herein. The process includes combining a dye and a starch to form a dye mixture. The process further includes combining the dye mixture, a styrene acrylate emulsion sizing agent, and an aluminum salt to form the size press composition. The dye, the starch, the aluminum salt, and the styrene acrylate emulsion sizing agent are substantially homogeneously dispersed within the size press composition based on visual observation utilizing a microscope at 10× magnification.

20 Claims, 4 Drawing Sheets

(51) Int. Cl.

| | |
|---|---|
| ***D21H 21/28*** | (2006.01) |
| ***D21H 17/00*** | (2006.01) |
| ***D21H 19/20*** | (2006.01) |
| ***D21H 17/66*** | (2006.01) |
| ***D21H 17/28*** | (2006.01) |
| ***D21H 19/34*** | (2006.01) |
| ***D21H 17/42*** | (2006.01) |

(52) U.S. Cl.
CPC ..... *D21H 17/74* (2013.01); *D21H 19/20* (2013.01); *D21H 19/34* (2013.01); *D21H 21/28* (2013.01)

(58) Field of Classification Search
CPC ..... D21H 17/42; D21H 17/25; D21H 19/72; D21H 27/18
See application file for complete search history.

(56) References Cited

U.S. PATENT DOCUMENTS

| | | | | |
|---|---|---|---|---|
| 6,268,414 | B1 | 7/2001 | Lin | |
| 6,316,095 | B1 * | 11/2001 | Black | D21H 17/14 428/323 |
| 7,745,525 | B2 | 6/2010 | Koenig | |
| 7,998,311 | B2 | 8/2011 | Varnell | |
| 8,361,573 | B2 | 1/2013 | Koenig | |
| 8,632,659 | B2 * | 1/2014 | Ehrhardt | D21H 17/17 162/164.6 |
| 8,871,055 | B2 | 10/2014 | Ehrhardt | |
| 9,028,650 | B2 * | 5/2015 | Ehrhardt | D21H 17/17 162/164.6 |
| 9,034,953 | B2 | 5/2015 | Zhou | |
| 9,365,979 | B2 | 6/2016 | Castro et al. | |
| 2006/0185807 | A1 | 8/2006 | Becker et al. | |
| 2006/0260774 | A1 | 11/2006 | Rodriguez et al. | |
| 2010/0018660 | A1 | 1/2010 | Varnell | |
| 2012/0248366 | A1 * | 10/2012 | Ehrhardt | D21H 21/16 252/8.83 |
| 2016/0060812 | A1 | 3/2016 | Castro et al. | |
| 2016/0251804 | A1 * | 9/2016 | Castro | D21H 19/54 428/537.5 |
| 2017/0335520 | A1 | 11/2017 | Ehrhardt et al. | |

OTHER PUBLICATIONS

Anderson, J., et al. "Surface Sizing," Surface Application of Paper Chemicals, First Edition 1997, Chapter 7, Chapman & Hall.
Andersson, C., "New Ways to Enhance the Functionality of Paperboard by Surface Treatment—a Review", Wiley Interscience, Packaging Technology and Science, 2008.

* cited by examiner

COMPOSITIONS AND METHODS FOR IMPROVING PROPERTIES OF LIGNOCELLULOSIC MATERIALS

TECHNICAL FIELD

The present disclosure generally relates to surface sizing of paper products and more particularly compositions and methods for improving properties of lignocellulosic materials utilizing an aluminum salt and a styrene acrylate emulsion (SAE) sizing agent.

BACKGROUND

Styrene acrylate emulsion (SAE) sizing agent have been widely used in the paper and paperboard industry as surface sizing agents to improve the water resistance of paper and paperboard. Depending on the monomers employed in synthesis, these SAE sizing agents can be cationic, anionic, or amphoteric, all used industrially at well-defined conditions.

These SAE sizing agents are either used by themselves or coupled with sizing aids, such as aluminum salts, and most notably aluminum sulfate (alum) and polyaluminum chloride (PAC). Once ionized in an aqueous solution, the aluminum cation helps fasten the sizing agent onto the negatively charged cellulose fibers. These sizing aids are strongly cationic and conventionally only utilized with cationic SAE sizing agents in the size press.

While polyvalent metal ions such as aluminum are effective sizing aids, the cationic nature of the aluminum ion in solution limits the papermaker and paperboard manufacturer to using only cationic dyes, cationic optical brightening agents (OBA), and other cationic additives when added to the size press. Further, cationic SAE sizing agents must also be utilized in the sizing process with the aluminum salt which results in an increase in cost for the sizing process due to the increase in cost of cationic SAE sizing agents relative to anionic SAE sizing agents. Anionic dyes, anionic OBAs, and other anionic additives will lead to the formation of coacervates with positively charged polyvalent cations, in this case aluminum from the aluminum salt. Coacervates and deposits will also form if these aluminum salts are combined with anionic SAE sizing agents.

When anionic dyes are used in the paper and board making process, typically anionic surface sizing agents, such as anionic SAE sizing agents, and solutions of styrene maleic anhydride, or styrene acrylic acid polymers are used for sizing. Aluminum salts, such as PAC and alum, cannot be used as these salts are strongly cationic. This is problematic as anionic SAE sizing agents do not bond effectively with fibers due to the negative charge on both the SAE and the fiber thereby leading to reduced sizing at equivalent dosages to the cationic system. Thus, a solution is needed for improved performance of this combination.

Accordingly, it is desirable to provide compositions and methods for utilizing SAE sizing agents, such as anionic SAE sizing agents, and aluminum salts with dyes and OBAs, such as anionic dyes and OBAs. Furthermore, other desirable features and characteristics will become apparent from the subsequent summary and detailed description and the appended claims, taken in conjunction with the accompanying drawings and the foregoing technical field and background.

BRIEF SUMMARY

Various non-limiting embodiments of compositions for improving properties of lignocellulosic materials, and various non-limiting embodiments of methods for the same, are disclosed herein.

In a non-limiting embodiment, a size press composition for improving properties of lignocellulosic material is provided herein. The size press composition includes, but is not limited to, an aluminum salt and an anionic styrene acrylate emulsion (SAE) sizing agent. The aluminum salt and the anionic SAE sizing agent are substantially homogeneously dispersed within the size press composition based on visual observation utilizing a microscope at 10× magnification.

In another non-limiting embodiment, a size press composition for improving properties of lignocellulosic material formed by a process is provided herein. The process includes, but is not limited to, combining a dye and a starch to form a dye mixture. The process further includes, but is not limited to, combining the dye mixture, a styrene acrylate emulsion (SAE) sizing agent, and an aluminum salt to form the size press composition. The dye, the starch, the aluminum salt, and the SAE sizing agent are substantially homogeneously dispersed within the size press composition based on visual observation utilizing a microscope at 10× magnification.

In another non-limiting embodiment, a method of sizing paper is provided herein. The method includes, but is not limited to, combining a dye and a starch to form a dye mixture. The method further includes, but is not limited to, combining the dye mixture, a styrene acrylate emulsion (SAE) sizing agent, and an aluminum salt to form a size press composition. The method further includes, but is not limited to, applying the size press composition to a lignocellulosic material. The dye, the starch, the aluminum salt, and the SAE sizing agent are substantially homogeneously dispersed within the size press composition based on visual observation utilizing a microscope at 10× magnification.

BRIEF DESCRIPTION OF THE DRAWINGS

Other advantages of the disclosed subject matter will be readily appreciated, as the same becomes better understood by reference to the following detailed description when considered in connection with the accompanying drawings wherein.

DETAILED DESCRIPTION

Figure 1:
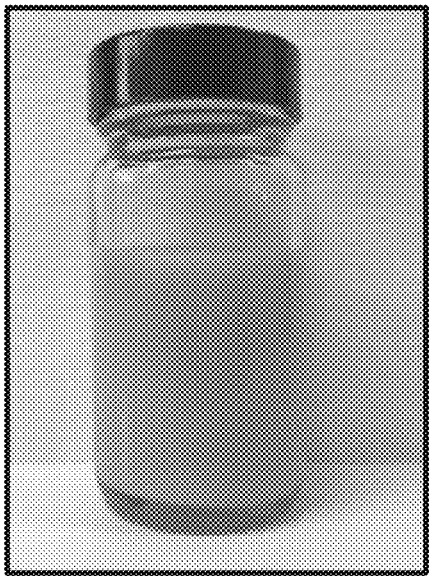
FIG. 1 is an image of a non-limiting embodiment of a sizing solution.

The following detailed description is merely exemplary in nature and is not intended to limit the systems and methods as described herein. Furthermore, there is no intention to be bound by any theory presented in the preceding background or the following detailed description.

The following description provides specific details, such as materials and dimensions, to provide a thorough understanding of the present disclosure. The skilled artisan, however, will appreciate that the present disclosure can be practiced without employing these specific details. Indeed, the present disclosure can be practiced in conjunction with processing, manufacturing, or fabricating techniques conventionally used in the paper industry. Moreover, the processes below describe only steps, rather than a complete process flow, for manufacturing the inventive size press composition according to the present disclosure.

As used herein, "a," "an," or "the" means one or more unless otherwise specified. The term "or" can be conjunctive or disjunctive. Open terms such as "include," "including," "contain," "containing" and the like mean "comprising." The term "about" as used in connection with a numerical value throughout the specification and the claims denotes an interval of accuracy, familiar and acceptable to a person skilled in the art. In general, such interval of accuracy is ±10%. Thus, "about ten" means 9 to 11. All numbers in this description indicating amounts, ratios of materials, physical properties of materials, and/or use are to be understood as modified by the word "about," except as otherwise explicitly indicated. As used herein, the "%" described in the present disclosure refers to the weight percentage unless otherwise indicated. As used herein, the phrase "substantially free of" means that a composition contains little or no specified ingredient/component, such as less than about 1 wt %, 0.5 wt %, or 0.1 wt %, or below the detectable level of the specified ingredient.

A size press composition is provided herein for improving properties of lignocellulosic material. The size press composition includes an aluminum salt and an anionic styrene acrylate emulsion (SAE) sizing agent. The aluminum salt and the anionic SAE sizing agent are substantially homogeneously dispersed within the size press composition based on visual observation utilizing a microscope at 10× magnification. In certain embodiments, the size press composition further includes a starch. The starch, the aluminum salt, and the anionic SAE sizing agent are substantially homogeneously dispersed within the size press composition based on visual observation utilizing a microscope at 10× magnification. In exemplary embodiments, the size press composition further includes a dye. The dye, the starch, the aluminum salt, and the anionic SAE sizing agent are substantially homogeneously dispersed within the size press composition based on visual observation utilizing a microscope at 10× magnification. The composition may be utilized for sizing paper. A size press is typically used to apply the composition to the surface of paper or paperboard to improve smoothness, printability, strength and resistance to aqueous penetrants. The size press composition is applied to the paper in a size press apparatus either on the paper machine (on-machine) or in a separate size press apparatus (off-machine).

In various embodiments, the size press composition is formed by a process including the step of combining the dye and the starch to form a dye mixture. In an effort to minimize coagulation of the dye when combined with the aluminum salt (cationic), the dye is first combined with the starch to form the dye mixture. The dye and the starch may be combined utilizing any manner known in the art so long as the dye and the starch are well blended, such as by utilizing a static mixer or blend tank equipped with an overhead impeller. In certain embodiments, the process further includes the step of mixing the dye and the starch utilizing agitation. The dye mixture may include the dye in an amount of from about 1 to about 20 wt. % based on a total weight of the dye mixture. The dye mixture may include the starch in an amount of from about 1 to about 20 wt. %. It is to be appreciated that the dye could be pre-mixed with a portion of the starch prior to combination with the size press composition which may include another portion of the starch. Thus, the disclosure is not limited to the ranges described immediately above for the amount of dye and starch, and may be combined in any amount known in the art so long as the dye is combined with starch prior to forming the size press composition. Further, it is to be appreciated that the dye and starch may be combined upstream in a paper machine relative to introduction of the PAC and SAE sizing agent into the paper machine thereby rendering the time period between the combination of the dye and the starch, and the introduction of the PAC and SAE sizing agent to account for the step of mixing.

The process further includes the step of combining the dye mixture, the SAE sizing agent, and the aluminum salt to form the size press composition. The dye mixture, the SAE sizing agent, and the aluminum salt may be combined individually to form the size press composition. The dye mixture, the SAE sizing agent, and the aluminum salt may be combined utilizing any manner known in the art so long as the dye mixture, the SAE sizing agent, and the aluminum salt are well blended, such as by utilizing a static mixer.

In other embodiments, the steps of combining the dye mixture, the SAE sizing agent, and the aluminum salt to form the size press composition includes the step of combining the SAE sizing agent and the aluminum salt to form a sizing solution and combining the dye mixture and the sizing solution to form the size press composition. The SAE sizing agent and the aluminum salt may be combined utilizing any manner known in the art so long as the SAE sizing agent and the aluminum salt are well blended, such as by utilizing a static mixer. In embodiments, a stable sizing solution can be achieved when combining anionic, cationic, or amphoteric SAE sizing agent with the aluminum salt (cationic). In certain embodiments, the sizing solution includes the aluminum salt and the SAE sizing agent in a weight ratio of from about 1:20 to about 20:1, alternatively from about 1:5 to about 5:1, or alternatively from about 1:3 to about 3:1.

The dye, the starch, the aluminum salt, and the SAE sizing agent are substantially homogeneously dispersed within the size press composition based on visual observation utilizing a microscope at 10× magnification. The term "substantially", as utilized herein, means that at least 80 wt. %, alternatively at least 90 wt. %, alternatively at least 95 wt. %, or alternatively at least 99 wt. % of the size press composition based on a total weight of the size press composition is homogeneously dispersed. The term "homogeneously dispersed" means that the components of the size press composition are dispersed uniformly throughout the size press composition. Visual observation utilizing a microscope at 10× magnification may be performed on a sample of the size press composition utilizing a microscope configured with an optical lens at 10× magnification and a backlight. It is to be appreciated that visual observations of the size press composition may be performed using a microscope at a magnification of less than 10×, or without the aid of magnification, so long as the components of the size press composition are substantially homogeneously dispersed therein based on visual observation utilizing a microscope at 10× magnification. The sample size may be one drop from a 7.5 ml disposable transfer pipet (VWR #414004-004). The drop was placed on a 75×25 mm microslide, single frosted (Corning 2948-75×25). A cover slip was placed on top (VWR Micro cover glass 25×25, Cat. No 48366249).

The dye utilized in the size press composition may be any dye known in the art. The dye may include basic dyes, acid dyes, anionic dyes, cationic dyes, or combinations thereof. In certain embodiments, the dye is an anionic dye. Suitable anionic dyes are commercially available from Archroma of Reinach, Switzerland under the tradename Cartasol, such as Cartasol® F and from Kemira of Helsinki, Finland under the tradename of Levacell/PontamineKS, such as a Levacell red dye and a Levacell brown dye. Suitable cationic dyes are commercially available from Archroma of Reinach, Switzerland under the tradename Cartasol, such as Cartasol® K and from Kemira of Helsinki, Finland under the tradename of Levacell/PontamineKS, such as Fast Blue KS-6GLL. The dye is generally added to the dye composition as an aqueous solution or dispersion, but can also be added in solid form. The size press composition may include the dye in an amount of from 0.001 to about 2 wt. %, alternatively from about 0.001 to about 1 wt. %, or alternatively from about 0.001 to about 0.5 wt. %, based on a total weight of the size press composition. Alternatively, the size press composition may include the dye in an amount up to 2 wt. %, alternatively up to 1 wt. %, or alternatively up to 0.5 wt. %, based on a total weight of the size press composition.

The starch utilized in the size press composition may be derived from any of the known sources, for example corn, potato, rice, tapioca, and wheat. The starch may be converted by means of enzyme, acid or persulfate treatments. The starch may also be modified, including cationic, oxidized, ethylated, amphoteric, hydrophobically and the like. Other water soluble hydroxylated polymers that can be used include carbohydrates such as alginates, carrageenan, guar gum, gum Arabic, gum ghatti, pectin and the like. Modified cellulosics such as carboxymethyl cellulose or hydroxyethylcellulose can be used. Synthetic water soluble hydroxylated polymers such as fully and partially hydrolyzed polyvinyl alcohols can also be used. Any water soluble hydroxylated polymer that can be applied to paper at a size press is suitable. Expressed as pounds of dry starch per ton of dry paper (lb/T), starch addition levels can range from 0 to about 120 lb/T (or from 0 to about 6 wt. % based on a total weight of the dry paper), alternatively from about 40 to about 100 lb/T (or from about 2 to about 5 wt. % based on a total weight of the dry paper), or alternatively from about 60 to about 100 lb/T (or from about 3 to about 5 wt. % based on a total weight of the dry paper). The size press composition may include the starch in an amount of from 1 to about 25 wt. %, alternatively from about 2 to about 22 wt. %, or alternatively from about 4 to about 18 wt. %, based on a total weight of the size press composition.

The SAE sizing agent may be utilized in the size press composition to improve the water resistance of paper and paperboard. The SAE sizing agent may also be referred to as a styrene acrylate emulsion (SAE) copolymer. The SAE sizing agents may be amphiphilic molecules including a hydrophilic group and a hydrophobic group. The hydrophilic group may face a fiber of the paper and paperboard and the hydrophobic group may extend away from the fiber thereby forming a water-resistant finish on the paper and paperboard. The SAE sizing agent may be cationic, anionic, or amphoteric which is dependent on the monomers employed in synthesis of the SAE sizing agent. As introduced above, in certain embodiments, the SAE sizing agent is anionic. The anionic SAE sizing agent is generally more cost effective to utilize in the size press composition as compared to the cationic SAE sizing agent.

The SAE sizing agent may be in the form of a latex. The styrene SAE sizing agent may be formed from a reaction mixture including styrene or substituted styrene, alkyl acrylate or methacrylate, ethylenically unsaturated carboxylic acid, or combinations thereof.

The alkyl group of the alkyl acrylate or methacrylate may contain from 1 to 12 carbon atoms. Exemplary alkyl acrylates or methacrylates include, but are not limited to, methyl methacrylate, ethyl acrylate, ethyl methacrylate, propyl acrylate, butyl acrylate, n-butyl acrylate, t-butyl acrylate, butyl methacrylate, 2-ethylhexyl acrylate, 2-ethylhexyl methacrylate, lauryl acrylate, lauryl methacrylate, and combinations thereof.

Examples of suitable ethylenically unsaturated carboxylic acids may include, but are not limited to, α,β-unsaturated carboxylic acids such as acrylic acid, methacrylic acid, maleic acid or anhydride, fumaric acid, itaconic acid, and combinations thereof.

Examples of suitable styrenes or substituted styrenes may include, but are not limited to, styrene, α-methylstyrene, vinyl toluene, and combinations thereof.

In certain embodiments, the SAE sizing agent is formed from a reaction mixture including styrene and butyl acrylate. The SAE sizing agent may be formed from a reaction mixture including styrene in an amount of from about 10 to about 90, alternatively from about 25 to about 75, or alternatively from about 33 to about 67, based on a molar ratio of the SAE sizing agent.

The SAE sizing agent may have a $T_g$ in an amount of from about −15° C. to about 90° C., alternatively from about 5° C. to about 80° C., or alternatively from about 30° C. to about 70° C.

Examples of suitable SAE sizing agents are commercially available from Solenis International LP of Wilmington, Del. under the tradenames Chromaset 800 and Impress ST-730.

The size press composition may include the SAE sizing agent in an amount of from 0.001 to about 12.5 wt. %, alternatively from about 0.006 to about 5 wt. %, or alternatively from about 0.05 to about 4 wt. %, based on a total weight of the size press composition. The SAE sizing agent may be applied to the paper in an amount of from about 0.005 to about 1 wt. %, alternatively from about 0.02 to about 0.5 wt. %, or alternatively from about 0.2 to about 0.3 wt. %, based on a total dry weight of the paper.

The aluminum salt is an inorganic salt that may improve dewatering and retention in paper and paperboard applications. Suitable aluminum salts include, but are not limited to, aluminum sulfate with the formula of $Al_x(SO_4)_y(H_2O)_z$, where x is 1 to 3, y is 1 to 4 and z is 0 to 20. A suitable aluminum sulfate, conventionally referred to as alum, is commercially available from General Chemical Corporation of New Jersey. Other aluminum salts include polyaluminum compounds with the formula of $Al_n(OH)_mX_{(3n-m)}$, wherein X is a negative ion such as chloride, sulfate, silicate, or acetate, and n and m are integers greater than zero, such that $(3_{n-m})$ is greater than zero. When X is chloride, the salt is polyaluminum chloride (PAC). A mixture of salts may also be used. In certain embodiments, the aluminum salt includes aluminum sulfate (alum), polyaluminum sulfate, polyaluminum chloride, polyaluminum chlorohydrate, polyaluminum chlorosulfate, or combinations thereof. In an exemplary embodiment, the aluminum salt includes polyaluminum chloride. Polyaluminum chloride is cationic and exhibits varying basicity. The chemistry of polyaluminum chloride is often expressed in the form $Al_n(OH)_mCl(3_{n-m})$ where basicity can be defined by the term m/(3n) in that equation. In embodiments, as described above, the polyaluminum chloride which is cationic can be combined with the anionic dye, so long as the anionic dye is first combined with the starch. Examples of suitable polyaluminum chlorides are commercially available from Solenis International LP of Wilmington, Del. under the tradenames Perform PB9007 (high basicity PAC) and Prequel 737 (low basicity PAC).

The size press composition may include the aluminum salt in an amount of from about 0.002 to about 6.5 wt. %, alternatively from about 0.003 to about 5 wt. %, or alternatively from about 0.008 wt % to about 2.5% based on the amount of the aluminum element of the aluminum salt and based on a total weight of the size press composition. The aluminum salt may be applied to the paper in an amount of from about 0.01 to about 0.5 wt. %, alternatively from about 0.02 to about 0.4 wt. %, or alternatively from about 0.05 to about 0.2 wt. %, based on a total dry weight of the paper.

The size press composition may further include an optical brightening agent. Optical brightening agents may compensate for the yellow cast (bleached paper or textile has a yellowish color) of paper or paperboard. The yellow cast may be present by the absorption of short-wavelength light (violet-to-blue). With optical brightening agents, this short-wavelength light may in part replaced, thus a complete white may be attained without loss of light. This additional light may be produced by the brightening agent by fluorescence. Optical brightening agents may absorb the invisible portion of the daylight spectrum and convert this energy into the longer-wavelength visible portion of the spectrum, i.e., into blue to blue-violet light. The optical brightening agent may be anionic or cationic. In certain embodiments, the optical brightening agent is anionic. Examples of suitable optical brightening agents include, but are not limited to, Stilbene and derivatives of Stilbene, or combinations thereof. The optical brightening agent may be utilized in an amount of at least 0.5 wt % based on paper produced.

The size press composition may further include conventional size press additives known in the art, such as salts, fillers, defoamers, biocides, waxes, additional sizing agents, or combinations thereof. Known additional sizing agents may include, alkyl ketene dimers, alkenyl succinic anhydrides, fatty acid anhydrides, etc. Typically, the size press composition has a pH below about 6, and a temperature of from about 0 to about 99° C., alternatively from about 45 to about 99° C.

For the purposes of this application, the term sizing refers to the ability of paper or board to resist penetration by aqueous liquids. Compounds that are designed to increase the hold-out of liquids are known as sizing agents. Sizing values are specific to the test used. One common tests for measuring the resistance to aqueous penetrants is the Cobb test, described below. For a discussion on sizing see Principles of Wet End Chemistry by William E. Scott, Tappi Press 1996, Atlanta, ISBN 0-89852-286-2. Descriptions of various sizing tests can be found in The Handbook of Pulping and Papermakinq by Christopher J. Biermann Academic Press 1996, San Diego, ISBN 0-12-097362-6 and Properties of Paper: An Introduction ed. William E. Scott and James C. Abbott Tappi Press 1995, Atlanta, ISBN 0-89852-062-2. The sized paper typically has a sizing value greater than about 1 second, alternatively greater than about 20 seconds, or alternatively greater that about 100 seconds, as measured by the Hercules Sizing Test (HST). Higher HST values represent more sizing.

A paper or paperboard that is sized with the size press composition according to the disclosure is formed from lignocellulosic material and can contain wood-based pulp from groundwood to chemically bleached wood or a non-wood based pulp or a combination of pulps. In addition, the pulp may be obtained in whole or in part from recycled paper and paper products. The pulp may contain some synthetic pulp. The pulp may be some combination of pulp types, such as hardwood and soft wood or a certain type of wood, such as *Eucalyptus*. The pulp may be groundwood pulp, mechanical pulp, chemically or thermally treated pulp, kraft pulp, sulfite pulp or synthetic pulp or any other common pulp used in the paper industry. The paper may or may not contain inorganic fillers, such as calcium carbonate or clay, and may or may not contain organic fillers, sizing agents and other additives added at the wet-end of the paper machine. The paper also can contain strength additives, retention additives, and other common paper additives, such as alum. In some embodiments, the lignocellulosic material is further defined as recycled linerboard.

The disclosure is applicable to sizing one or both sides of paper or board. When only one side is being treated, all of the above levels relating to the paper will be one half of the values listed.

The final paper may contain other additives included in the formation of the paper or applied along with the sizing composition surface treatment or separately from the sizing composition surface treatment. The additives applicable are those which are utilized in paper. They include but are not limited to the following: inorganic and organic fillers, such as clay or hollow sphere pigments; optical brightening agents, which are also known as fluorescent whitening aids; pigments; dyes; strength additives, such as polyamidoamines; sizing agents, such as rosin, AKD, ASA, and waxes; and inorganic salts.

A method of sizing paper is also provided herein. The method may include the step of combining the dye and the starch to form the dye mixture. The method further includes the step of combining the dye mixture, the SAE sizing agent, and the aluminum salt to form the size press composition. The method further includes the step of applying the size press composition to the lignocellulosic material. The dye, the starch, the aluminum salt, and the SAE sizing agent are substantially homogeneously dispersed within the size press composition based on visual observation utilizing a microscope at 10× magnification.

The step of applying the size press composition to the lignocellulosic material, such as paper or paperboard is not limited provided that uniform controlled application is obtained. The application may be made to paper formed on a paper machine and then only partially dried, or it can be made on a paper machine to dried paper or the application can be performed separate from the paper machine to paper that was formed, dried, and moved. A typical process is for paper to be formed with a paper machine and dried. The size press composition may then be applied with a paper machine size press. Then, the paper is dried again. The paper may be further modified by calendering. The applicable grades of paper are those with basis weights from about 50 to about 350 g/m$^2$ or alternatively from about 70 to about 250 g/m$^2$.

While at least one exemplary embodiment has been presented in the foregoing detailed description of the disclosure, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention. It being understood that various changes may be made in the function and arrangement of elements described in an exemplary embodiment without departing from the scope of the disclosure as set forth in the appended claims.

EXAMPLES

Example 1—Exemplary and Comparative Sizing Solutions (SAE/PAE Solution)

In Example 1, 25 grams of an anionic SAE sizing agent (imPress ST-730) and 25 grams of polyaluminum chloride (PAX 18, available from Kemira Oyj) were combined and mixed under agitation for 1 minute by swirling the container by hand to form an exemplary sizing solution.

A comparative sizing solution was formed by combining 0.9 grams of the exemplary sizing solution and 48 grams of deionized water with mixing to form an intermediate solution. Next, the intermediate solution and 0.2 grams of an anionic dye (Levacell red dye, available from Kemira Oyj) were combined with mixing under agitation for 5 minutes utilizing an overhead mixer to form the comparative sizing solution.

Figure 2:
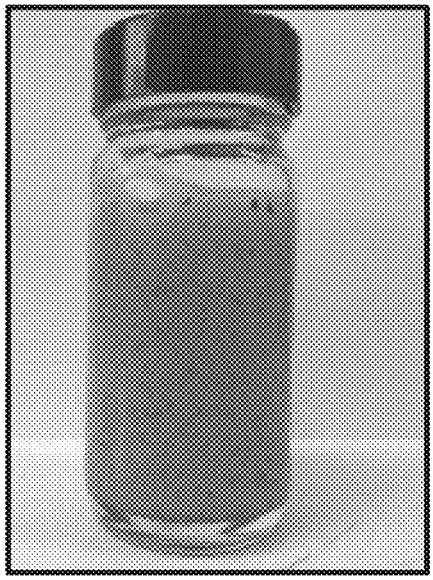
FIG. 2 is an image of a comparative sizing solution.

After formation of the exemplary and comparative sizing solutions, the solutions were evaluated utilizing visual observation without magnification. Results of the visual observations are provided in Table 1 below and images of the solutions are provided in FIG. 1 (exemplary) and FIG. 2 (comparative).

TABLE 1

| Sample | Visual Observation |
|---|---|
| Exemplary sizing solution | Homogeneous |
| Comparative sizing solution | Significantly Coagulated |

The exemplary sizing solution where the anionic SAE and cationic PAC are combined was homogeneous. In contrast, the comparative sizing solution where the anionic SAE, cationic PAC, and the anionic dye are combined was significantly coagulated.

Example 2—Exemplary and Comparative Size Press Compositions

In Example 2, 2.275 grams of an anionic SAE sizing agent (imPress ST-730) and 2.275 grams of polyaluminum chloride (PAX 18, available from Kemira Oyj) were combined to form a sizing solution.

An exemplary size press composition was formed by first combining 193.97 grams of a 10% starch (GPC D28F, an oxidized corn starch available from Grain Processing Corporation) solution and 1.46 grams of an anionic dye (Levacell brown dye, available from Kemira) and mixing to form a uniform dye mixture. Next, the dye mixture and the sizing solution were combined and mixed under agitation for 15 minutes utilizing an overhead mixer to form the exemplary size press composition.

A comparative size press composition was formed by first combining 4.55 grams of the sizing solution and 193.97 grams of the starch and mixing to form an intermediate solution. Next, the intermediate solution and 1.46 grams of the anionic dye were combined and mixed under agitation for 15 minutes utilizing an overhead mixer to form the comparative size press composition.

Figure 3A:
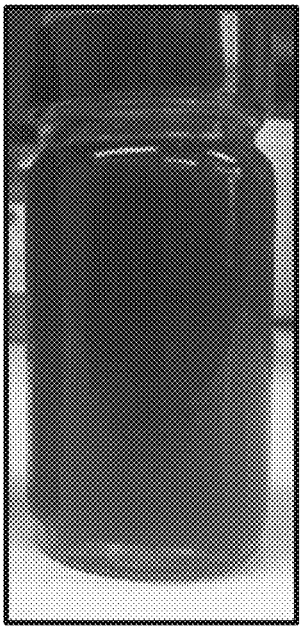
FIG. 3A is an image, without magnification, of a non-limiting embodiment of a size press composition.
Figure 3B:
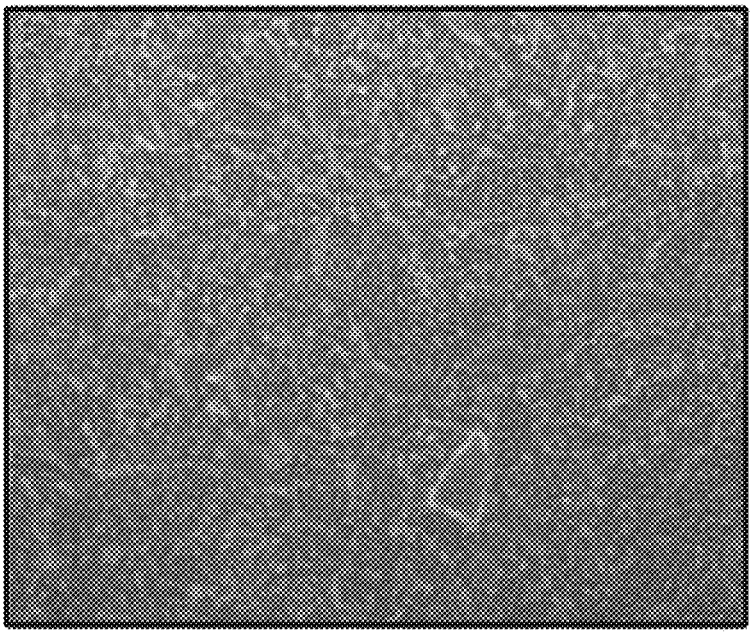
FIG. 3B is an image, with magnification, of a non-limiting embodiment of the size press composition of FIG. 3A.
Figure 4A:
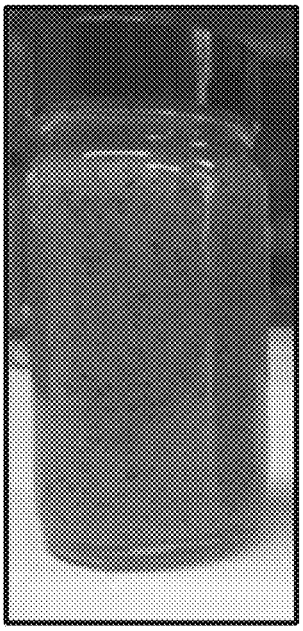
FIG. 4A is an image, without magnification, of a comparative size press composition.
Figure 4B:
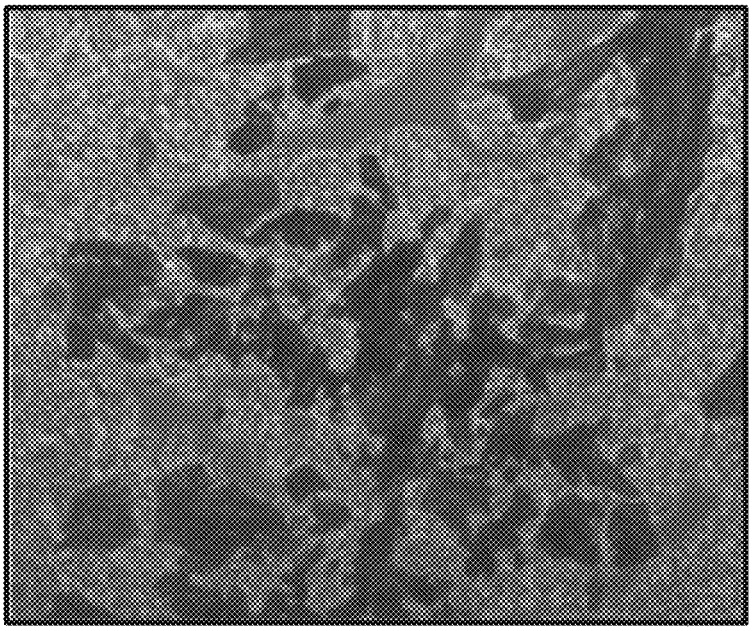
FIG. 4B is an image, with magnification, of the comparative size press composition of FIG. 4A.

After formation of the exemplary and comparative size press compositions, the compositions were evaluated utilizing visual observation under a microscope configured with an optical lens at 10× magnification and a backlight and without a microscope. Results of the visual observations are provided in Table 2 below and images of the compositions are provided in FIG. 3A (exemplary) and FIG. 4A (comparative), without magnification, and FIG. 3B (exemplary) and FIG. 4B (comparative), with 10× magnification.

TABLE 2

| Sample | Visual Observation |
|---|---|
| Exemplary size press composition | Homogeneous |
| Comparative size press composition | Significantly Coagulated |

The exemplary size press composition where the anionic dye and the starch were combined prior to combination with the SAE/PAC solution was homogeneous and provided a superior size press composition for sizing paper. In contrast, the comparative size press composition where the anionic dye was not combined with the starch prior to combination with the SAE/PAC solution was significantly coagulated and thus could not be used for sizing paper.

Example 3—Performance of Size Press Compositions Using Cobb Test

The Cobb test measures sizing by measuring the quantity of water absorbed by a sample of paper in a specified time as the paper is held between a metal ring and a plate. An area of 100 $cm^2$ of paper is exposed to 100 ml of water with the water at a height of 1 cm. In advance of testing, the paper (approximately 12.5×12.5 cm) is cut out and weighed. For the Cobb tests here, the water was kept on the paper for 3 minutes. After pouring off the water, the ring is quickly removed and the sample is placed with wetted side up on a sheet of blotting paper. A second sheet of blotting paper is placed on top of the sample and a hand roller of 10 kg is run over the papers once forward and then backward. Care should be taken not to exert downward force on the roller. The paper sample is removed from the blotting papers and reweighed. The results are reported as the amount of water in grams absorbed per square meter of paper. A complete description of the test and the test equipment are available from Gurley Precision Instruments.

Figure 5:
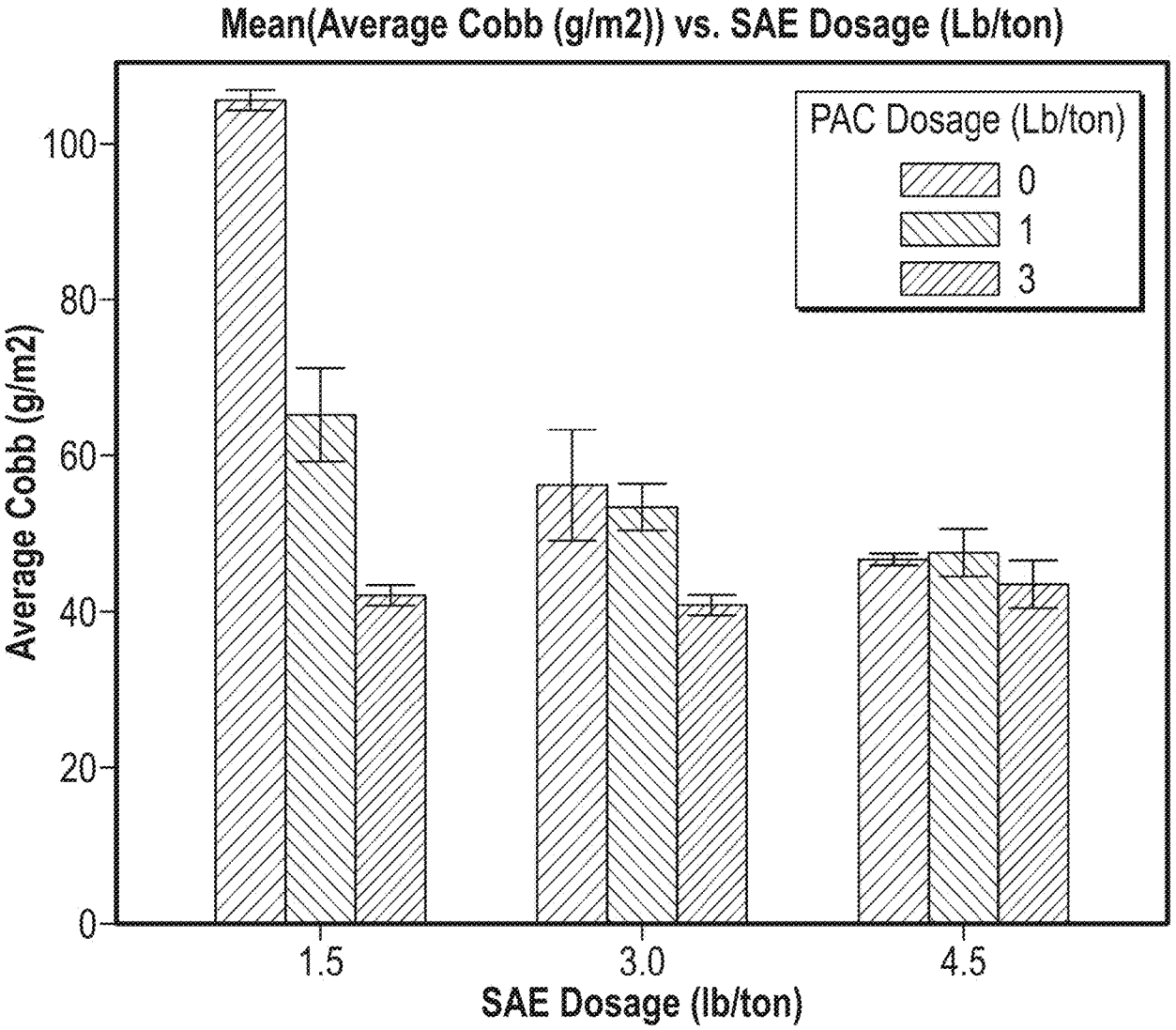
FIG. 5 is a chart illustrating experimental data of non-limiting embodiments of sizing solutions.
Figure 6:
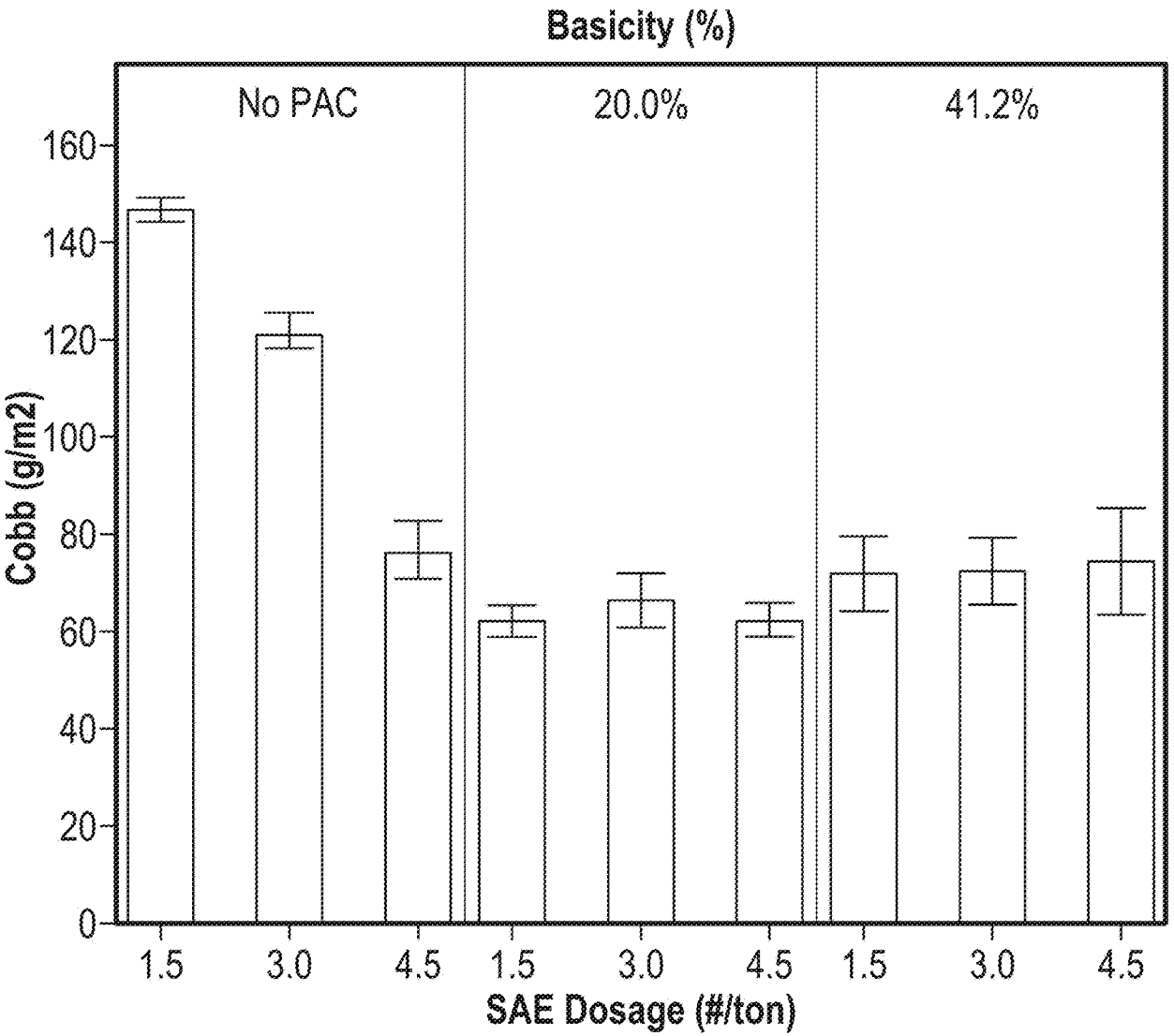
FIG. 6 is a chart illustrating experimental data of non-limiting embodiments of size press composition.

In FIG. 5, the effect of PAC dosage on efficacy using an anionic SAE (Chromaset 800) was studied for the exemplary sizing solution, wherein increasing the PAC dosage, increased the water fastness as manifested in the improved Cobb values. Low and medium basicity PACs (20.0% basicity: UP1692 and 41.2% basicity: UP1040) were employed with anionic SAE (Chromaset 800) and yielded approximately the same Cobb values at the similar dosage conditions. Thus, the basicity of the PAC used does not play a major role in the enhancing the efficacy of the exemplary sizing solution as shown in FIG. 6.

Example 4—Stability of Sizing Solutions (SAE/PAE Solution)

Stable sizing solutions were prepared by blending an anionic SAE sizing agent (Chromaset 800) with a high basicity PAC (Perform PB9007) at different ratios, as indicated in Table 3. Stability was assessed by monitoring the particle size of the blends over time.

TABLE 3

| Sample | Amount of Anionic SAE parts | Amount of PAC parts | Particle Size, Horiba LA-300 Initial Mean (um) | Initial Median (um) | Initial D90 (um) | 4 weeks Mean (um) | 4 weeks Median (um) | 4 weeks D90 (um) |
|---|---|---|---|---|---|---|---|---|
| 4A | 375 | 125 | 0.150 | 0.144 | 0.194 | 0.147 | 0.142 | 0.186 |
| 4B | 250 | 250 | 0.150 | 0.143 | 0.193 | 0.146 | 0.144 | 0.184 |
| 4C | 125 | 375 | 0.150 | 0.143 | 0.193 | 0.146 | 0.141 | 0.185 |

Anionic SAE is an anionic styrene acrylate emulsion commercially available from Solenis International LP of Wilmington, Delaware under the tradename Chromaset 800.
PAC is a high basicity polyaluminum chloride commercially available from Solenis International LP of Wilmington, Delaware under the tradename Perform PB9007.

The sizing solutions, 4A, 4B, and 4C, including various weight ratios of anionic SAE and PAC, exhibit stability based on particle size after storage at room temperature for 4 weeks. In particular, sizing solutions, 4A, 4B, and 4C, exhibit a minimal change in particle size after storage at room temperature for 4 weeks.

Example 5—Recycled Linerboard Sizing Evaluation—Dixon Coater

Paper samples for the examples below were prepared using either a laboratory puddle size press or a Dixon coater as a puddle size press for higher speed applications. The general procedures are described here. Specific details are listed with each example. For the bench size press and Dixon coater experiments, base papers were prepared in advance on a commercial or pilot paper machine. The papers were made without any size press treatment, i.e., no starch, sizing agent, or other additives were applied to the surface of the formed paper. The pulp used to make the papers was prepared from recycled paper streams. The basis weight and sheet characteristics varied depending on source.

The size press formulations were prepared by cooking the starch for 45 minutes at 95° C., cooling, holding the starch at the target treatment temperature, typically 60 to 70° C. Other additions and any pH adjustments were made and then the starch solution was used to treat the paper. For each base paper used, the amount of solution picked up through the rollers was determined and the additive levels set accordingly to give the target pick-up.

The benchtop puddle size press included a horizontal set of ten inch (25.4 cm) pinched rollers, one rubber coated and one metal, through which the paper was fed. A puddle of the size press treatment was held by the rollers and dams on the top side of the rollers. The rollers were held together with 14 pounds of air pressure. The paper passed through the puddle as it was pulled by the rollers, and through the rollers, to give a controlled and uniform level of treatment. The paper was allowed to sit for 30 seconds and then run through the size press a second time. After the second pass through the size press the paper was captured below the two rollers and immediately dried on a drum drier set at 210° F. The paper was dried to about a 3 to 5% moisture level. After drying, each sample was conditioned by aging at room temperature.

The Dixon coater has a puddle size press, through which the base sheet can be fed at speeds up to 1300 feet/min. The puddle size press consists of a horizontal set of 22 cm rubber rolls, pressed together at 50 psi. The sheet is dried to a moisture content of 5 to 7%, using an IR dryer at 160° C.

Comparative (comp.) sizing solutions and the exemplary (ex.) sizing solutions of Example 4 were added to a starch solution (GPC D28F oxidized starch, 8.46% solids at 60 C) to form size press compositions and applied to the surface of recycled medium (55#/T starch pickup, 2.75 wt % based on dry board) using a Dixon coater as a pilot size press, with no other additives. Sizing performance of the size press compositions were evaluated using the Cobb Test and HST. In particular, the Cobb Test was run for 2 minutes and for 30 minutes. The HST was performed using #2 FA Ink and 80% Reflectance. The results of sizing evaluations conducted on the surface treated board are listed in Table 4 and show that the SAE/PAC blends provide resistance to aqueous penetrants superior to standard anionic surface sizing agents.

TABLE 4

| Sample | Type | Amount of Anionic SAE parts | Amount of PAC parts | Dosage of Size Press Composition (lbs/T) | Cobb Test (2 min.) ($g/m^2$) | Cobb Test (30 min.) ($g/m^2$) | HST (sec.) |
|---|---|---|---|---|---|---|---|
| 5A | Comp. | 0 | 0 | 0 | 131 | 201 | 2 |
| 5B | Comp. | 500 | 0 | 2 | 105 | 125 | 15 |
| 5C | Comp. | 500 | 0 | 4 | 88 | 116 | 37 |
| 5D | Comp. | 500 | 0 | 8 | 43 | 105 | 84 |
| 5E | Ex. | 375 | 125 | 2 | 51 | 105.5 | 22 |
| 5F | Ex. | 375 | 125 | 4 | 32 | 108 | 44 |
| 5G | Ex. | 375 | 125 | 8 | 27 | 91 | 86 |
| 5H | Ex. | 250 | 250 | 2 | 44 | 119 | 26 |
| 5I | Ex. | 250 | 250 | 4 | 33 | 91 | 52 |
| 5J | Ex. | 250 | 250 | 8 | 27 | 85 | 91 |
| 5K | Ex. | 125 | 375 | 2 | 36 | 99 | 31 |
| 5L | Ex. | 125 | 375 | 4 | 31 | 98.5 | 56 |
| 5M | Ex. | 125 | 375 | 8 | 29 | 85.5 | 81 |

Anionic SAE is an anionic styrene acrylate emulsion commercially available from Solenis International LP of Wilmington, Delaware under the tradename Chromaset 800.
PAC is a high basicity polyaluminum chloride commercially available from Solenis International LP of Wilmington, Delaware under the tradename Perform PB9007.

The exemplary recycled linerboards, 5E-5M, including various weight ratios of anionic SAE and PAC, and at various dosage amounts, exhibit improved sizing performance according to the Cobb Test and HST as compared to the comparative recycled linerboards, 5A-5D.

What is claimed is:

1. A size press composition for improving properties of lignocellulosic material, the size press composition comprising an aluminum salt and an anionic styrene acrylate emulsion sizing agent, wherein the aluminum salt and the anionic styrene acrylate emulsion sizing agent are homogeneously dispersed within the size press composition based on visual observation utilizing a microscope at 10× magnification.

2. The size press composition of claim 1 further comprising a starch, wherein the starch, the aluminum salt, and the anionic styrene acrylate emulsion sizing agent are homogeneously dispersed within the size press composition based on visual observation utilizing a microscope at 10× magnification.

3. The size press composition of claim 2 further comprising a dye, wherein the dye, the starch, the aluminum salt, and the anionic styrene acrylate emulsion sizing agent are homogeneously dispersed within the size press composition based on visual observation utilizing a microscope at 10× magnification.

4. The size press composition of claim 1, wherein the styrene acrylate emulsion sizing agent is formed from a reaction mixture comprising styrene and butyl acrylate.

5. The size press composition of claim 3, wherein the dye is anionic.

6. The size press composition of claim 1, wherein the aluminum salt comprises polyaluminum chloride.

7. The size press composition of claim 2 further comprising an anionic optical brightening agent.

8. A size press composition for improving properties of lignocellulosic material formed by a process comprising:

combining a dye and a starch to form a dye mixture; and combining the dye mixture, a styrene acrylate emulsion sizing agent, and an aluminum salt to form the size press composition;

wherein the dye, the starch, the aluminum salt, and the styrene acrylate emulsion sizing agent are homogeneously dispersed within the size press composition based on visual observation utilizing a microscope at 10× magnification.

9. The size press composition of claim 8, wherein the styrene acrylate emulsion sizing agent is anionic.

10. The size press composition of claim 9, wherein the styrene acrylate emulsion sizing agent is formed from a reaction mixture comprising styrene and butyl acrylate.

11. The size press composition of claim 8, wherein the dye is anionic.

12. The size press composition of claim 8, wherein the aluminum salt comprises poly-aluminum chloride.

13. The size press composition of claim 8, wherein the step of combining the dye mixture, the styrene acrylate emulsion sizing agent, and the aluminum salt to form the size press composition comprises:

combining the aluminum salt and the styrene acrylate emulsion sizing agent to form a sizing solution; and combining the dye mixture and the sizing solution to form the size press composition.

14. The size press composition of claim 13, wherein the sizing solution comprises the aluminum salt and the styrene acrylate emulsion sizing agent in a weight ratio of from about 1:20 to about 20:1.

15. A method of sizing paper, the method comprising:

combining a dye and a starch to form a dye mixture;

combining the dye mixture, a styrene acrylate emulsion sizing agent, and an aluminum salt to form a size press composition; and applying the size press composition to a lignocellulosic material;

wherein the dye, the starch, the aluminum salt, and the styrene acrylate emulsion sizing agent are homogeneously dispersed within the size press composition based on visual observation utilizing a microscope at 10× magnification.

16. The method of claim 15, wherein the styrene acrylate emulsion sizing agent is anionic.

17. The method of claim 16, wherein the styrene acrylate emulsion sizing agent is formed from a reaction mixture comprising styrene and butyl acrylate.

18. The method of claim 15, wherein the dye is anionic.

19. The method of claim 15, wherein the aluminum salt comprises polyaluminum chloride.

20. The method of claim 15, wherein the lignocellulosic material is further defined as recycled linerboard.

* * * * *